United States Patent [19]

Weidmann

[11] 4,313,472

[45] Feb. 2, 1982

[54] ELECTRONIC DEVICE FOR MONITORING THE WEFT INSERTION ON A GRIPPER SHUTTLE WEAVING MACHINE COMPRISING A COLOR CHANGER

[75] Inventor: Erich Weidmann, Wetzikon, Switzerland

[73] Assignee: Gebrüder Loepfe AG, Wetzikon, Switzerland

[21] Appl. No.: 111,771

[22] Filed: Jan. 14, 1980

[30] Foreign Application Priority Data

Jan. 29, 1979 [CH] Switzerland ..... 838/79

[51] Int. Cl.[3] ..... D03D 51/34

[52] U.S. Cl. ..... 139/370.2

[58] Field of Search ..... 139/453, 370.1, 370.2; 66/163; 340/675, 677; 324/72, 76 R

[56] References Cited

U.S. PATENT DOCUMENTS

| | | | |
|---|---|---|---|
| 2,817,367 | 12/1957 | Pfarrwaller | 139/453 |
| 3,440,634 | 4/1969 | Maurmann et al. | 139/370.2 |
| 3,676,769 | 7/1972 | Loepfe | 139/370.2 X |
| 3,833,026 | 9/1974 | Domig | 139/370.2 |

*Primary Examiner*—Henry Jaudon

*Attorney, Agent, or Firm*—Werner W. Kleeman

[57] ABSTRACT

An electronic weft or filling thread monitoring device on a gripper shuttle weaving machine provided with a rotatable color changing mechanism comprises a signal generator or weft thread travel sensor fixedly mounted in the area between the color changer and the point where the weft thread is transferred to the gripper shuttle or projectile. Only the one of the weft threads which is ready for transfer to the gripper shuttle is located in front of the signal generator without touching the same, and is lead in contact with the signal generator only when the projectile is driven into the weaving shed.

6 Claims, 16 Drawing Figures

ELECTRONIC DEVICE FOR MONITORING THE WEFT INSERTION ON A GRIPPER SHUTTLE WEAVING MACHINE COMPRISING A COLOR CHANGER

BACKGROUND OF THE INVENTION

The present invention relates to an electronic device for monitoring the weft or filling thread insertion on a gripper shuttle weaving machine provided with a color changing mechanism which transfers one of a plurality of weft threads drawn off fixedly mounted supply spools to a projectile which is ready for insertion into the weaving shed.

In its more specific aspects the gripper shuttle loom for which the electronic monitoring device is provided is of the type comprising a substantially cylindrical shell having an interior surface and rotatably mounted on a changer shaft and provided with groove in substantially parallel relationship to the changer shaft. Each groove receives a retract rod bearing a weft clamp for transferring, at a transfer point, one at a time of a multiplicity of threads drawn from supply bobbins, to a gripper shuttle ready for insertion into the weaving shed.

Such gripper shuttle loom working with freely propelled gripper shuttles or projectiles and a colour changing mechanism of the aforementioned type are illustrated in FIGS. 1, 2, 6 and 7 of U.S. Pat. No. 2,817,367. However, no weft thread monitoring device is provided on this known gripper shuttle loom.

In German Pat. No. 1,760,787 there is described a mechanically operating weft thread monitor on a gripper shuttle weaving machine equipped with a color changing device. With this known embodiment the weft or filling threads are drawn from supply spools located outside the weaving machine, and inserted into the weaving shed by projectiles or gripper shuttles which are picked off by a picking mechanism. Mechanical feelers are provided each of which senses one of the weft threads prior to entering the picking mechanism. The ones of the feelers which are adjoined to weft threads not ready to be inserted with the next shot remain idle.

In U.S. Pat. No. 4,051,871 there is shown an electronic device for monitoring weft yarn insertion on shuttleless looms, which device comprises a plurality, e.g. eight, transducers each to be activated by a weft yarn to be inserted. Photoelectrical, electromagnetic, capacitive, and in particular piezoelectrical transducers may be provided. A switch is individually associated with each transducer for being closed and activating the transducer upon insertion of the weft yarn associated thereto.

Generally weft thread monitors serve for stopping the weaving machine and activating an indicator in the event of an incorrect weft insertion and particularly weft break or rupture.

In addition to said known monitoring devices arranged at the picking side of the weaving machine, others are known which scan or monitor the weft thread already inserted in the shed on the catching side of a gripper shuttle weaving machine, that means in the last phase of the insertion. However, the present invention refers to monitors located at the picking side rather than catching side, such as to make possible monitoring of the weft or filling thread during the entire interval of weft insertion.

The known multi-color monitoring devices located on the picking side make use of a multiplicity of sensors or transducers each of which is associated with one of the weft threads to be inserted. Accordingly, the outlay for the production, assembly and continuous monitoring is substantial.

In order to avoid such an outlay, German Pat. No. 2,212,907 provides for an electronic thread monitor for gripper shuttle weaving machines comprising a single piezoelectrical signal generator or sensor mounted between a thread gripping point and the selvedge. A swivel arm is adjoined to each weft thread for transferring to the gripper the one thread which is to be inserted into the shed. Upon seizure of the thread by the gripper and return of the swivel arm to the starting position thereof, a rotatable thread control pin leads the weft yarn in contact with the signal generator. This electronic weft yarn monitor is relatively simply constructed, however it may be used only on gripper or rapier weaving machines of a rather specialized type rather than conventional gripper shuttle machines.

SUMMARY OF THE INVENTION

It is a primary object of the present invention to provide a novel construction of an electronic device for monitoring the weft or filling yarn insertion on a gripper shuttle or projectile weaving machine provided with a color changing mechanism or weft mixer.

It is another object of the invention to provide for such an electronic device in which no faulty signals produced by filling threads which are not to be inserted into the shed cannot affect the operation of the device.

A further objective of the invention is the provision of a rugged and inexpensive electronic weft yarn monitor for projectile weaving machines of the above-mentioned type.

The electronic monitoring device designed in accordance with a preferred physical manifestation of this invention possesses a very simple and robust construction and is practically insensitive to contaminants which normally are present during textile processing. The construction of the inventive electronic weft thread monitor possesses the particular advantage that only a single yarn travel sensor and only a single signal evaluation circuit is required for monitoring a number of threads. This feature considerably simplifies the construction and provides a rather extensive insensitivity against mechanical effects, such as impacts and vibrations which, as is well known in this particular art, oftentimes occur during loom operation.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
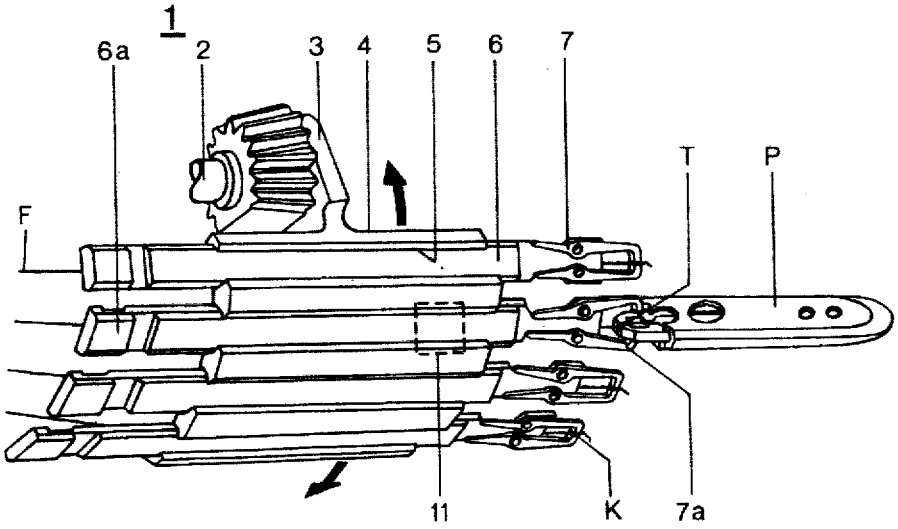
FIG. 1 shows the main part of the color changing mechanism and the projectile as viewed from the left side of the weaving machine.

With reference to FIG. 1, weft mixer 1 is mounted tiltably round a changer shaft 2. The elements of the weft mixer drive which effect the tilting movement are not shown. A sector 3 is rotatably mounted on changer shaft 2 and fixedly connected to the cylindrical shell 4. On the exterior surface of shell 4 there are provided four grooves 5, each of which is essentially parallel to changer shaft 2 and receives one of four retract rods 6. The right butt of each retract rod 6 bears a clamp 7 which normally grips the right end of a weft end extending from the left side up to clamp 7.

The second retract rod 6*a* whose clamp 7*a* is opened is aligned with the projectile P in picking position. Projectile P has taken over the weft end previously held by clamp 7*a* and is ready for being picked or shot off. The point of weft transfer T is in the middle between the jaws of clamp 7*a*.

By means of the mentioned weft mixer drive and a locking device (not shown), each of the retract rods 6 may be brought into the transfer position as represented by retract rod 6*a*, and locked in that position.

Figure 2:
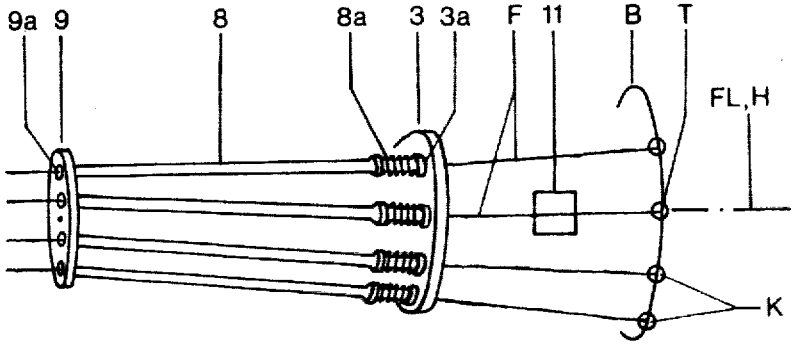
FIG. 2 is a schematic representation of the paths of the weft or filling threads in the region of the color changer.

FIG. 2 shows the path of the weft threads F in the region of the color changer 1 and the arrangement of signal generator 11. Only the tiltable sector 3 is shown in schematic representation rather than the other components represented in FIG. 1.

An apertured or perforated disc 9 fixedly mounted at the machine frame comprises four apertures 9*a* and serves as an abutment for the left ends of four thread guides or pipes 8. The right ends of the thread pipes 8 are movably supported at bores 3*a* of sector 3. The thread pipes 8 are telescopic such that the length thereof is automatically accommodated to the variable distance between the support points 3*a*,9*a*, through the force of springs 8*a*, when the sector 3 is being tilted.

Each weft thread runs from the left side through an aperture 9*a* of perforated disc 9, a thread pipe 8, a bore 3*a* of sector 3 and further unguided to a clamp point K, FIGS. 1 and 2. When sector 3 is rotated round changer shaft 2, the clamp points K describe a circular arc B. When weft mixer 1 is locked one of the clamp points K coincides with transfer point T which is the starting point of the trajectory FL of the projectile P.

In FIG. 2, the dash-dotted line FL represents the trajectory starting at point T as well as the trace of the horizontal plane H through the trajectory. The schematically depicted signal generator 11 is arranged, in the direction of the trajectory FL of the gripper shuttle P, between sector 3 and transfer point T on a level with the gripper shuttle P and immediately upstream of the transfer point. In the vertical direction signal generator 11 is arranged in the horizontal plane H. Also, as apparent from the illustration of FIG. 7, the signal generator 11 is fixedly mounted at the weaving machine between the interior surface of the cylindrical shell 4 and the changer shaft 2 such as to face the weft thread F which is ready for insertion without contacting the same.

Figure 3A:
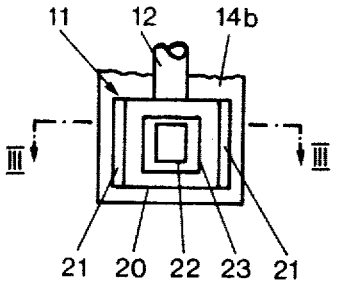
FIGS. 3*a*, 3*b* and 3*c* show a triboelectrical signal generator or thread sensor in front and side view and in horizontal crosssectional view, respectively.
Figure 3B:
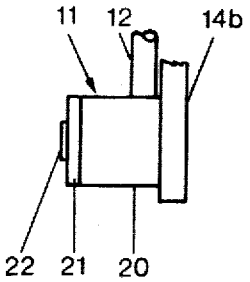
Figure 3C:
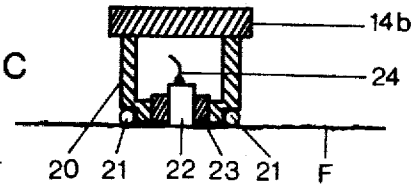
Figure 7:
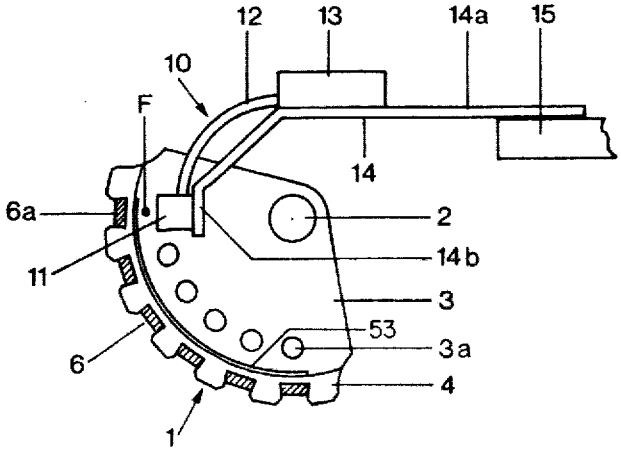
FIG. 7 shows the arrangement of a monitoring device including a signal generator, as viewed from the right side of the weaving machine to the weft mixer.
Figure 8A:
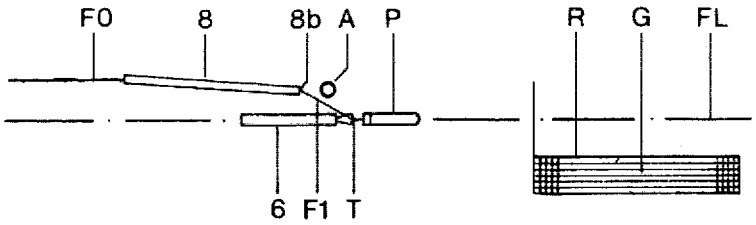
FIGS. 8*a*, 8*b*, 8*c* and 8*d* are schematic representations of subsequent phases of the weft travel in the area of the weft mixer in plan view.
Figure 8B:
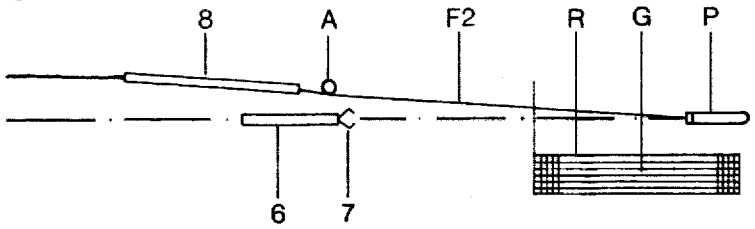
Figure 8C:
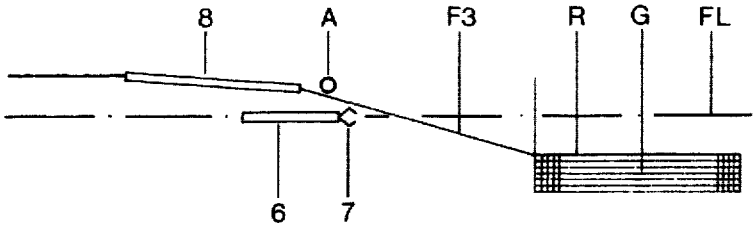
Figure 8D:
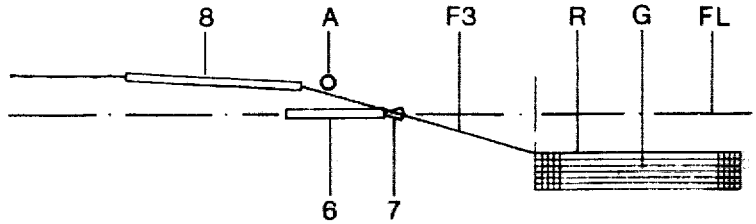

In FIGS. 3*a* and 3*b* there is shown a triboelectrical signal generator 11, in front view and side view, respectively, and in FIG. 3*c* in horizontal cross-sectional view along the line III—III in FIG. 3*a*. Signal generator 11 is mounted at the butt or lower end 14*b* of a bracket 14 which is shown in FIG. 7. The principles of the design and structure as well as the mode of operation of triboelectrical signal generators are described in U.S. Pat. No. 3,676,769. The particular form of the tactile signal generator or transducer 11 is adapted to the problem to be solved here.

Signal generator 11 comprises a casing 20, two thread guides 21, a collector electrode, briefly collector 22, and an insulator 23. FIG. 3*c* further shows the end of an internal conductor 24 of a concentric cable 12 which internal conductor 24 is connected to collector 22. Signal generator 11 is depicted in a scale somewhat greater than the practical embodiments. Collector 22 forms a tactile triboelectrical sensor.

Casing 20 is substantially shaped as a cube or box and consists of electrically conducting material, such as metal. It is connected to ground through the outer conductor of concentric cable 12 and acts as a screening to collector 22 and the thereto attached end of internal conductor 24. At the front wall of casing 20 there are provided at both edges of casing 20 vertical grooves in each of which there is bonded a thread guide 21 of ceramic material shaped as a cylindrical rod.

A rectangular recess of the front wall of casing 20 receives the collector 22 embedded in insulator 23. Collector 22 consists of a hard electrically conducting material, such as brass. As shown in FIGS. 3*b* and 3*c*, the front surface of collector 22 extends slightly, in the order of some tenth millimeters, over the front surface of casing 20, in order to ensure that a thread traveling over thread guides 21 (FIG. 3*c*) contacts collector 22 and produces an electrical signal indicative of the traveling yarn.

Figure 4A:
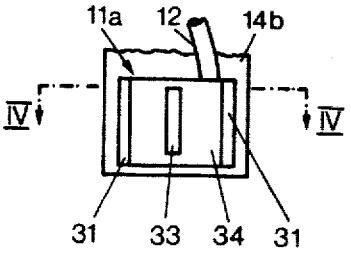
FIGS. 4*a*, 4*b* and 4*c* show a piezoelectrical signal generator in three different views similar to the ones of FIG. 1.
Figure 4B:
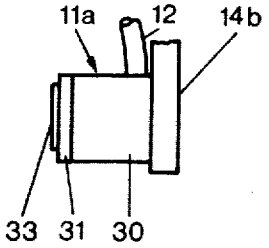
Figure 4C:
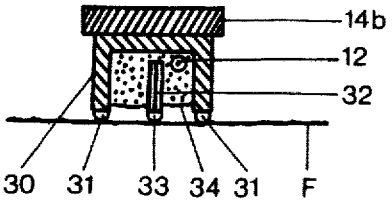

The tactile signal generator 11*a* shown in FIGS. 4*a*, 4*b* and 4*c* is of substantially the same overall dimensions as the triboelectrical signal generator 11. FIGS. 4*a* and 4*b* are front and side views of signal generator 11*a*, and FIG. 4*c* is a crosssectional view thereof along the line IV—IV in FIG. 4*a*. Signal generator 11*a* comprises a casing 30, two thread guides 31 attached to casing 30, a piezoelectrical element or bimorph device 32, a thread guide 32 bonded thereto, and a bearing material 34. Piezoelement 32 and thread guide 33 bonded thereto form a piezoelectrical sensor. The piezoelectrical signal generator 11*a* is mounted on the end or butt 14*b* of a bracket 14 and connected with a pre-amplifier 13 by a cable 12 as shown in FIG. 7.

Casing 30 is shaped as a substantially U-element whose opening is directed to the front side. To the free vertical edges of the U-shaped casing 30 there are attached thread guides 31 made of ceramic material. The piezoelectrical element or bimorph plate 32 is arranged between the legs of the U, and the front edge of piezoelectrical element 32 bears a thereto bonded thread guide 33 which prevents wear by the traveling thread. The piezoelectrical element 32 is embedded in a soft elastic bearing material 34 and thus fixed in casing 30. Bearing material 34 may consist of a soft elastic sealing compound or sound absorbing porous matter, such as foam rubber. The electrodes attached to the piezoelectrical element 32 and their connections with cable 12 which are not shown in the Figures may be of conventional design.

The piezoelectrical sensor 32,33 acts as a mechanical vibrator which is excited in resonant modes by the traveling yarn. The resonant vibrations are damped by the action of the bearing material 34. The input circuit of pre-amplifier 13, FIG. 7, connected to the piezoelectrical element 32 by cable 12 may be tuned to one of the natural frequencies of the piezoelectrical element 32. Thus it is possible to enhance the amplitude of the signal indicative of yarn travel and to attain a high signal-to-noise ratio.

Figure 5:
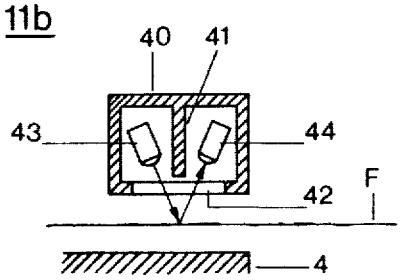
FIGS. 5 and 6 show horizontal sectional views of two different optoelectrical signal generators in schematic representation.

With reference to FIG. 5, there is shown an optoelectrical signal generator **11*b* in horizontal cross-section along plane H, FIG. 2. A case-shaped casing 40 comprising a vertical partition wall 41 receives an IR light emitting diode 43 and a phototransistor or optoelectrical sensor 44. A light beam emitted by LED 43 passes through a window 42 to weft thread F where it is reflected back through window 42 and to phototransistor 44. In order to avoid ambient light or light reflected from shell 4 of weft mixer 1, FIG. 1, to act on phototransistor 44 the interior surface of shell 4 facing window 42** may be blackend or provided with a dark layer. Weft thread F is shown as being inserted into the shed.

Figure 6:
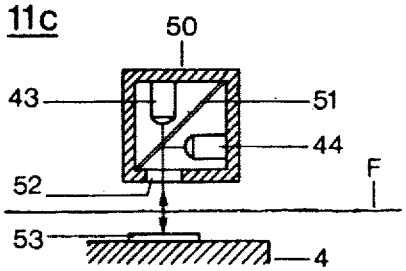

FIG. 6 shows in similar representation as FIG. 5 another optoelectrical signal generator **11*c* cooperating with a retroreflecting device 53, e.g. a "Scotchlite" tape, fixed to the interior surface of shell 4. The cubic casing 50 houses a vertically and diagonally arranged semipermeable reflector 51. An IR-LED 43 is located at the rear side and a phototransistor 44 at the front side of semipermeable reflector 51. The light beam emanating from LED 43 passes through semipermeable reflector 51, window 5, by weft thread F to retroreflector 53 and back through window 52 to phototransistor 44**.

The traveling weft thread F produces an irregular or noise signal in the above-described signal generator **11,11*a*, 11*b*,11*c***. The noise signal is amplified by A.C. amplifying means, rectified and supplied to a device indicating the yarn or thread travel condition.

FIG. 7 is a schematic representation of a six color mixer 1 as veiwed from projectile P, FIG. 1, with the retract rods **6,6*a* in vertical cross-sectional view. In FIG. 7, the same reference numerals are used as in FIG. 1 for similar or corresponding components. Sector 3 which is rotatable round changer shaft 2 is provided with six bores 3*a* the upper of which is masked by signal generator 11. Retract rod 6*a* is in the position facing signal generator 11 when weft thread F is transferred to the projectile P, FIG. 1. The section of weft thread F located between shell 4 and signal generator 11 does not contact signal generator 11 when thus positioned. This also holds for the other weft threads (not shown in FIG. 7) when they pass by signal generator 11 upon rotating round changer shaft 2; weft mixer 1 is freely rotatable round changer shaft 2 without the weft threads touching signal generator 11**.

Sensing device 10 comprises the signal generator 11, a shielded cable 12, and a pre-amplifier 13. For fixing sensing device 10 at the frame 15 of the loom a bracket 14 is provided comprising a horizontal arm **14*a* and a butt or end 14*b* extending downward. Butt 14*b* bears signal generator 11 in such a position that it is located at the level of the one weft thread F which is ready for being inserted into the shed. When weft thread F is drawn off in longitudinal direction for insertion, such weft thread F comes into contact with signal generator 11, and the latter produces an electrical noise signal as stated above. The horizontal arm 14*a* of bracket 14 above weft mixer 1 bears preamplifier 13 connected to signal generator 11 through the shielded cable 12 of low capacity. The output of pre-amplifier 13 may be connected to further circuits of an electronic weft monitor (not shown) in conventional manner, such as to cause stoppage of the loom in the event of a weft breakage. When using a triboelectrical signal generator 11, a coaxial cable 12 of low capacity and small length should be provided for attaining a low capacity in the input circuit of pre-amplifier 13. That means that the distance between pre-amplifier 13 and signal generator 11** should be chosen as small as possible with regard to the spatial dimensions of the weaving machine.

In FIG. 7, signal generator 11 and pre-amplifier 13 of sensing device 10 are represented as single units interconnected by a cable 12. Normally, i.e. when there is room enough available, the signal generator and pre-amplifier should be lodged in one and the same casing. In the present case, however, there is normally not room enough for such a condensed unit of normal size within the weft mixer 1; therefore, signal generator 11 is arranged and mounted within the weft changer 1 as a separate unit.

However, when the dimensions of the signal generator and pre-amplifier can be further reduced such as to be lodged in a sufficiently small casing, such a unit should be mounted in the interior space of weft changer 1 in place of the signal generator 11 shown in FIG. 7.

FIGS. **8*a*–8*d* show a retract rod 6 with clamp 7, a thread pipe 8 with outlet 8*b*, projectile P, the trajectory FL in the horizontal plane, the transfer point T and the rim R of the textile web G. Further, there is shown the sensing point A which is located, on the tactile signal generators 11 and 11*a* of FIGS. 3*a*,3*b*,3*c* and 4*a*,4*b*,4*c*, respectively, substantially in the midpoint of collector 22 and thread guide 33, respectively. Various sections or paths of the weft thread F are designated F0, F1,F2, and F3**.

FIG. **8*a* shows the first phase: thread section F0 is received in thread pipe 8, and thread end F1 is transferred to projectile P at transfer point T. Such thread end F1 does not touch sensing point A between outlet 8*b*** and transfer point T.

FIG. **8*b*, second phase: projectile P is shot off or propelled and traveling through the weaving shed. Thread end F2 drawn off by projectile P contacts the sensing point A, and the associated signal generator 11** detects the longitudinal movement of the weft thread.

FIG. **8*c*, third phase: upon insertion of the weft thread, the latter is beaten up to the rim or bell R of the web G, then occupying position F3**.

FIG. **8*d*, fourth phase: retract rod 6 is shifted toward rim R, and clamp 7 has seized the thread end F3**.

Thereupon, thread end F3 is severed by a severing device (not shown) at a point on the right of clamp 7, and retract rod 6 returns to its starting position shown in FIG. **8*a***. Tensioning means (not shown) keep the thread tensioned during the retraction phase.

Figure 9:
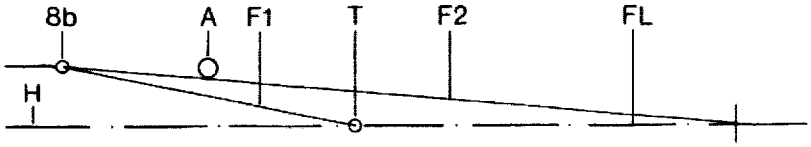
FIG. 9 shows the angular movement of the path of the weft or filling thread in the interval between two subsequent phases.

FIG. 9 shows, at a somewhat greater scale, the angular deviation of the thread paths F1 and F2 in the horizontal plane. Thread F1 in starting position does not touch sensing point A of the signal generator. During the weft insertion, the weft thread assumes position F2 where it contacts sensing point A. This event is essential for tactile signal generators or sensors which respond only if the thread contacts the signal generator. Moreover, this arrangement is also advantageous since free rotation of the weft mixer 1 without acting upon the signal generator is only feasible in case all the threads in the color changer occupy the start position F1.

While there are shown and described present preferred embodiments of the invention, it is to be distinctly understood that the invention is not limited thereto but may be otherwise variously embodied and practiced within the scope of the following claims. Accordingly,

What I claim is:

1. An electronic device for monitoring the insertion of weft threads into a weaving shed on a gripper shuttle weaving machine equipped with a color changing mechanism, comprising a substantially cylindrical shell having an interior surface and rotatably mounted on a changer shaft and provided with grooves in substantially parallel relationship to the changer shaft, each groove receiving a retract rod bearing a weft clamp for transferring, at a transfer point, one at a time of a multiplicity of threads drawn from supply bobbins, to a gripper shuttle ready for insertion into the weaving shed, wherein:

a signal generator responsive to longitudinal movement of the thread to be inserted is fixedly mounted at the weaving machine between the interior surface of the cylindrical shell and the changer shaft in a position antecedent to the transfer point essentially on a level with the gripper shuttle and such as to face the weft thread ready for insertion without contacting the same.

2. The electronic device as defined in claim 1, wherein: the signal generator comprises a tactile thread sensing means which is contacted by the weft thread when the latter is inserted into the weaving shed by the gripper shuttle.

3. The electronic device as defined in claim 2, wherein: the signal generator comprises a tactile triboelectrical sensing means.

4. The electronic device as defined in claim 2, wherein: the signal generator comprises a tactile piezoelectrical sensing means.

5. The electronic device as defined in claim 1, wherein: the signal generator comprises an optoelectrical sensing means.

6. The electronic device as defined in claim 1, further including: a pre-amplifier while together with said signal generator form an integral unit.

* * * * *